United States Patent [19]

Cardulla

[11] Patent Number: 5,022,767

[45] Date of Patent: Jun. 11, 1991

[54] SELF SUPPORTING TRASH BAG

[76] Inventor: Richard Cardulla, 801 Independence Ave., S.E., Washington, D.C. 20003

[21] Appl. No.: 476,000

[22] Filed: Feb. 6, 1990

[51] Int. Cl.[5] ..... B65D 33/02

[52] U.S. Cl. ..... 383/33; 383/104; 220/9.3; 141/390

[58] Field of Search ..... 383/33, 34, 34.1, 104, 383/35; 220/9.1, 9.2, 9.3; 141/390

[56] References Cited

U.S. PATENT DOCUMENTS

| | | | |
|---|---|---|---|
| 1,180,574 | 4/1916 | Despot | 220/9.3 |
| 1,714,308 | 5/1929 | Gunderson | 141/390 |
| 3,934,803 | 1/1976 | Paulus | 141/390 X |
| 4,003,455 | 1/1977 | Cortese | 383/4 X |
| 4,509,570 | 4/1985 | Eby et al. | 141/390 |

FOREIGN PATENT DOCUMENTS

| | | | |
|---|---|---|---|
| 340702 | 1/1931 | United Kingdom | 220/9.3 |

*Primary Examiner*—Stephen Marcus
*Assistant Examiner*—Jes F. Pascua

[57] ABSTRACT

The product of the present invention is a flexible plastic trash bag which includes as an integral part a paper or plastic wrapped thin metal wire support formed into two attached hoops. The oblong metal hoops are attached to the bag on each vertical side and to each other for ⅓ of their vertical length. The encased wire is thin enough so as not to interfere with the folding or rolling of the bag; but strong enough to support the weight of the empty bag. The present invention comprises of forming a plastic bags, in various sizes, out of sheet plastic and attaching metal wire hoops to its vertical seems so that when the two hoops are separated at the top and bottom the bag is self-supporting and maintained in an open position so that matter may be easily deposited. Since the bag requires no receptacle the bag may be made from plastic of colorful patterns.

The present invention addresses the problem mentioned above of holding a flexible trash bag both open and upright by means of an integral flexible metal skeleton that when opened; by the insertion of the hand into the mouth of the bag, provides support for the bag and at the same time holds the bag open for its entire length.

In the present invention, the flexible plastic bag includes a bottom, two sides, an open mouth and two (2) oblong metal hoops (approximately the same length and width of the bag) joined for ⅓ of the of their vertical sides and attached to each side of the vertical seams of the bag by glue and/or heat seal for the full length of their joined sides.

3 Claims, 1 Drawing Sheet

SELF SUPPORTING TRASH BAG

TECHNICAL FIELD

The invention relates to flexible bags such as trash bags having an open end and means for maintaining the open end in an open position and the bag up-right.

BACKGROUND OF INVENTION

The present invention relates to plastic trash bags that are at present used as liners for waste receptacles. The problem of holding the end in the open position is addresses in U.S. Pat. Nos.3,942,832; 4,159,139; 4,867,576, and 4,747,701. It would be desirable if the open end of a bag could be kept open without a supporting receptacle.

Other patents disclosing means for holding the mouth of a bag or sack open are disclosed in U.S Pat. Nos. 4,048,691; 4,341,410; and 4,509,570. None of these patents make the bag self-supporting while holding the mouth open.

SUMMARY OF THE INVENTION

In general, the product of the present invention is a plastic garbage or waste bag which includes a flexible metal frame that can be folded or rolled for packaging. When an individual bag is separated from the roll or pack it is then pulled or pressed flat. The mouth is then opened and both hands inserted the full length of the bag; the arms are then spread, which opens the wire hoops so that the bag is stretched open for its full length and supported in an up-right position by the wire.

The plastic bag is formed by sheet plastic which is glued or heat sealed on its vertical sides over the sides of the metal hoops; making the hoops an integral part of the bag. The hoops are formed of flexible metal, enclosed in paper or plastic, and similar to that used to tie garbage bags closed or plants to stacks and which are more commonly called "twists".

The present invention provides a garbage or container bag that is self-supporting and free-standing and requires no receptacle. At the same time it maintains a mouth open position making it easy to deposit articles within. Since no receptacle is required, the plastic bag can be made out of decorative sheet plastic material so that the bag can fit various decors.

BRIEF DESCRIPTION OF THE DRAWINGS

The present invention is understood from the detailed description to follow, and from the attached drawings which show.

DETAILED DESCRIPTION OF THE DRAWING

Figure 1:
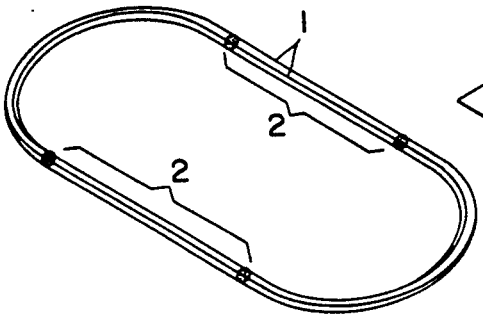
FIG. 1 is a perspective view of the two (2) attached metal hoops.

FIG. 1 shows two oblong metal hoops (1) which are attached to each other at the middle for ⅓ the distance of each of their longest sides (2) by glue, twisting or heat seal. They are constructed of thin metal wire of various sizes depending on the size of the plastic sack into which they will be attached. Steel wire of 20 gauge, encased in pastic or paper would be used for a 32 gallon plastic garbage bag. The ends are rounded, and sloped away from the vertical or long sides so as not to be attached to the bag when the seams of the bag are fastened. The only part of the hoops that will be attached to the bag is the ⅓ portion of their length (2).

Figure 2:
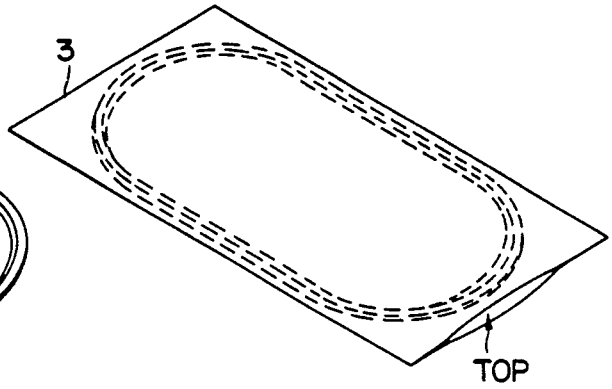
FIG. 2 is a perspective view of the present invention in the collapsed or un-opened position, showing the metal hoops as dotted lines.

FIG. 2 represents two sheets of thermoplastic (3) which can vary from 0.0005" to 0.0015" in thickness and is similar to that used in garbage bags. Shown by dotted lines are the metal hoops that are an integral part of the bag; and which are attached to the bag's vertical seams when the seams are heat sealed together. The metal hoop portion that is joined to the bag is only that portion as shown in FIG. 1, (2); which represents ⅓ of its length, and being the only portion of the hoops that are attached to each other.

Figure 3:
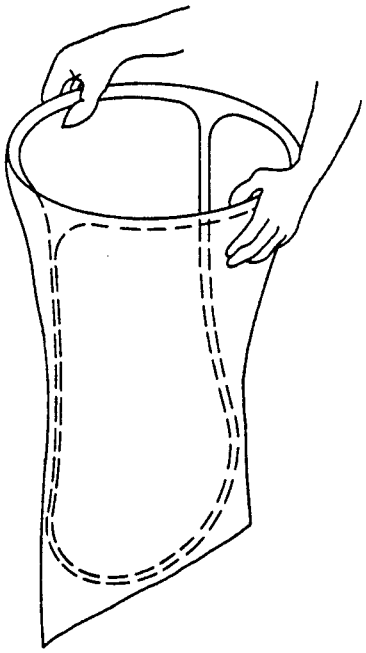
FIG. 3 is a perspective view of the present invention in the partially opened and up-right position, and in the process of being opened.
Figure 4:
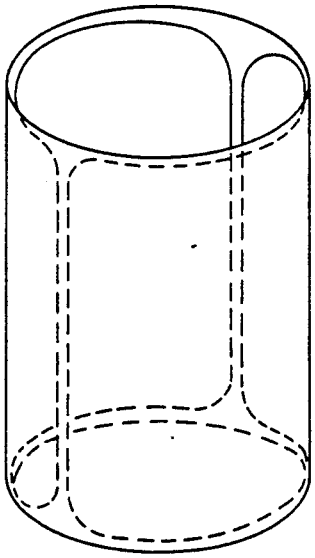
FIG. 4 is a perspective view of the present invention in the fully open and up-right position.

FIG. 3 shows the present invention in the process of being opened whereby the bag is grasped at the mouth or open end by the hands; and by pulling out on both the top lip of the bag and the tops of the two hoops, the mouth is fix or locked in the open position. The hands would then be inserted into the bag all the way to the bottom and the above mentioned procedure would be repeated for the bottom of the hoops. The bag would be supported in an up-right and open position approximately as shown in FIG. 4.

I claim:

1. A bag of thermoplastic material comprising an open top, a closed bottom and vertical seams in combination with a foldable, metal frame, said frame further comprising a pair of overlying, deformable oblong hoops having elongated portions fastened together within the vertical seams of the bag and located at one end of the elongated portions are tops of the hoops that remain unattached to each other and located at the opposite end of the elongated portions are bottoms of the hoops that remain unattached to each other, whereby upon bending the tops away from each other and upon bending the bottom away from each other, the bag is maintained in an open and upright position.

2. A bag according to claim 1 wherein the elongated portions are heat sealed within the vertical seams of the bag.

3. A bag according to claim 1 wherein the oblong loops are encased in plastic or paper.

* * * * *